US007222751B2

(12) United States Patent
Kerman et al.

(10) Patent No.: US 7,222,751 B2
(45) Date of Patent: May 29, 2007

(54) COLLAPSIBLE TUBE WITH A DISTRIBUTOR HEAD WITHOUT AIR RETURN

(75) Inventors: Eric Kerman, Chalons en Champagne (FR); Laure Mounier, Paris (FR); Bernard Schneider, Sainte Menehould (FR)

(73) Assignee: Cebal S.A.S., Gennevilliers (FR)

( * ) Notice: Subject to any disclaimer, the term of this patent is extended or adjusted under 35 U.S.C. 154(b) by 478 days.

(21) Appl. No.: 10/478,201

(22) PCT Filed: Aug. 14, 2002

(86) PCT No.: PCT/FR02/02877

§ 371 (c)(1),
(2), (4) Date: Feb. 9, 2004

(87) PCT Pub. No.: WO03/016159

PCT Pub. Date: Feb. 27, 2003

(65) Prior Publication Data

US 2004/0144809 A1 Jul. 29, 2004

(30) Foreign Application Priority Data

Aug. 17, 2001 (FR) ..... 01 10892

(51) Int. Cl.
*B65D 35/00* (2006.01)

(52) U.S. Cl. ..... 222/92; 222/494

(58) Field of Classification Search ..... 222/92, 222/206–215, 93–107, 494, 496
See application file for complete search history.

(56) References Cited

U.S. PATENT DOCUMENTS

| | | | | |
|---|---|---|---|---|
| 3,165,242 | A | 1/1965 | Jackson | |
| 4,635,826 | A | 1/1987 | Hatakeyama et al. | |
| 4,962,870 | A | 10/1990 | Schneider | |
| 5,829,645 | A * | 11/1998 | Hennemann | 222/189.09 |

FOREIGN PATENT DOCUMENTS

| | | |
|---|---|---|
| DE | 1173298 | 2/1964 |
| FR | 2732315 | 4/1996 |

* cited by examiner

*Primary Examiner*—Lien M. Ngo
(74) *Attorney, Agent, or Firm*—Dennison, Schultz & MacDonald

(57) ABSTRACT

Collapsible tube head (100, 200, 300, 400) comprising a neck (103, 203, 303, 403) which is fitted, with a port (180, 280, 380, 480) and a shoulder (102, 202, 302, 402). The aforementioned head is fitted with a valve (110, 210, 310, 410) which is inserted in the neck of the said collapsible tube, the said valve comprising a sealing means (112, 212, 312, 412) which is connected to a ring support (115, 215, 315, 415) having an opening (122, 222, 322, 422), the said sealing means being maintained in the closed position of the said opening when the tube is not compressed, and being maintained in the open position when the tube is compressed. The inner surface of the tube is provided with a bore (105, 205, 305, 405) which is disposed close to the base of the said neck. The ring support is fixed to the bore by means of bonding, soldering or force fitting, and the said bore and ring support are preferably provided with complementary connection means, in particular a groove and rice grains.

14 Claims, 4 Drawing Sheets

COLLAPSIBLE TUBE WITH A DISTRIBUTOR HEAD WITHOUT AIR RETURN

This application is a filing under 35 USC 371 of PCT/FR02/02877 filed Aug. 14, 2002.

TECHNICAL DOMAIN

The invention relates to collapsible tubes for storing and distributing liquid to pasty products keeping them protected from ambient air. These tubes are fitted with non-return pumps or valves to prevent pollution from ambient air, firstly by preventing product that has been expelled from the port from returning inside the tube, and secondly by preventing air from entering due to relaxation of the pressure on the pump or the skirt.

STATE OF THE ART

Application FR 2 630 998 deposited by the Applicant discloses a tube comprising a skirt and a head equipped with a distribution pump provided with an annular flange. This head is fixed on the skirt of the tube and comprises a shoulder connecting the skirt to a plastic cap moulded on the annular pump attachment flange. The nature of the semi-rigid plastic material in the cap is the same as the nature of the surface layers of the body or the skirt. The flange of the pump is embedded in the cap, which is consequently fairly thick. If the pump is an airless pump of the type disclosed in application FR 2 528 122 (VALOIS), there is no communication between the inside and outside of the tube. The pump attachment is particularly leak tight due to the fact that the flange is embedded in the moulded cap.

U.S. Pat. No. 3,438,554 (Schwartzman) discloses a one-way valve located in the neck of a collapsible tube with:

- a sealing element composed of a head flared outwards, housed in a valve seating formed on the flange surrounding the opening of the neck and connected to the end of a central rod extending over more than the height of the neck.
- a ring with a diameter larger than the inside diameter of the neck, that will be inserted inside the receptacle and connected to the other end of the rod located underneath the ring through elastic helical support elements. The flared head is elastic and deformable, and the ring is rigid. The sealing element is inserted into the neck from the inside, the flared head is deformed to get past the bore in the neck and is then released when it goes beyond the valve seating. The sealing element is then held fixed in the neck by the inside wall of the neck and the central part of the shoulder being trapped between its flared head and the rigid ring. This valve is similar to a valve operating in the opposite direction and that will supply an application pad on the opening output with a liquid product (U.S. Pat. No. 3,203,026). It prevents a fluid product from returning towards the inside of the tube; when the tube skirt is pressed, the product passes through the bore of the ring and then the bore of the neck, and flows between the elastic support elements of the sealing means and then applies a pressure on the inside of the flared head. The flared head is then moved away from the valve seating and releases the product that can flow outwards.

In his application FR 2 732 315, the Applicant discloses a double envelope tube comprising an outer envelope and an inner envelope, each of the two envelopes being provided with a neck, a shoulder and a skirt, in which the outer and inner envelopes are rigidly assembled to each other at the necks and shoulders, the sealing means of the opening in the neck of the inner envelope is connected through collapsible elastic tabs to the neck of the outer envelope, the set of tabs and the sealing means acting as an automatic valve, and in which a calibrated air passage is formed between the space separating the two envelopes at their skirt end and the space separating the two envelopes at their neck end, at the junction of the shoulders of the outer envelope and the inner envelope.

U.S. Pat. No. 4,635,826, "continuation-in part" of application JP58129269, discloses a tube in which the head is provided with a valve inserted in the neck of the said collapsible tube. The valve comprises a sealing means in the form of a "free" disk, which is free in the sense that it is not connected to any other elements of the valve and that it can move along a limited axial displacement. This disk is supported on a transverse wall in which an opening is formed, which is thus closed off by the disk. The said transverse wall is connected to a ring support and the said ring support is fixed to the inner wall of the neck. The valve is held in place inside the neck by axisymmetric click fit beads on the said ring support that fit into axisymmetric grooves with complementary shapes arranged around the inner surface of the neck.

PROBLEM THAT ARISES

The tube head made according to FR 2 630 998 is fairly expensive, particularly due to the quality of the pump associated with this head. Furthermore, the tube equipped with such a pump has a mediocre delivery ratio due to the large diameter of the rigid cap into which the flange of the pump is embedded. Furthermore, at the end of use it is observed that it is more and more difficult to fix the capsule that protects the diffuser connected to the pump because the periphery of the shoulder that acts as a housing at the bottom of the capsule is deformed. This deformation occurs because the user pressed the pump many times and no air enters the tube to compensate for the distributed volume of the product.

In his application FR 2 732 315, the Applicant attempted to solve these two problems by forming an outer skirt that returns to its initial shape after use and by suggesting a less expensive valve. Although the problem of deformation of the skirt and the shoulder has been solved, there are still moulding difficulties related to differences in thickness between the thin helical elastic arms supporting the sealing means and the remainder of the head. The presence of these helical arms moulded as a single piece with the neck make it necessary to make a large diameter port, due to the size of the mould. Furthermore, this type of tube cannot be manufactured at high production rates under satisfactory economic conditions.

The valve described in U.S. Pat. No. 3,438,554 is difficult to insert in the neck since the elastic flared head has to be deformed in the radial direction so that the neck and the inside of the central part of the shoulder can be trapped between this elastic head and the rigid ring. Apart from these difficult assembly problems when manufacturing at high production rates, this valve has a number of disadvantages in use; since the head has been predeformed so that it can be inserted in the neck, it does not always perfectly return to its initial shape, so that it does not make a sealed contact in its valve seating; moreover, the head comes out of the tube during use which weakens it. Finally, it always forms an obstacle in front of the port, with the result that the flow of extruded product that comes is not well controlled, either in terms of the distributed flow rate or the direction of the jet.

Finally, there are several disadvantages with the tube head disclosed in U.S. Pat. No. 4,635,826. Firstly, the disk with limited axial displacement does not always return to its closed position. Then, the head thus equipped with its valve is incapable of providing good product delivery ratios. A certain amount of the product always remains stuck to the walls at the bottom of the ring valve support that projects inside the volume delimited by the shoulder, and more of the product remains blocked in the large cylindrical volume delimited by the said ring support. Finally, although the assembly composed of the wall of the ring support and the wall of the neck is rigid enough to prevent the product contained in the cylindrical cavity that they surround from being emptied, they are still easily deformable and consequently make the attachment less reliable and less leak tight than what was originally required. Click fit beads with a large radial height (typically more than one millimetre) have to be formed to hold the valve in position inside the neck, but these beads form relief that is firstly difficult to remove from the mould, and secondly is easily damaged when the valve is inserted inside the neck.

Therefore, the Applicant has tried to find a "non-return" valve that is easy to make, easy to install in the tube neck and is capable of delivering the product with a controlled flow and in a controlled direction. It must be possible to make and fit this valve under conditions of large production series. Finally, it must remain held firmly in place in the neck for as long as the collapsible tube is in use, and the tube fitted with this valve must offer a good delivery ratio.

PURPOSE OF THE INVENTION

The object according to the invention is a collapsible tube head comprising a neck fitted with a port and a shoulder that will connect the said neck to the rest of the tube, the said head being fitted with a valve inserted in the neck of the said collapsible tube, the said valve comprising a sealing means associated with a ring support provided with an opening, the said sealing means being held in the closed position of the said opening when the tube is not compressed and in the open position when the tube is compressed, characterised in that the inner surface of the tube in the lower part of the neck that is the transition area between the shoulder and the neck, is provided with a bore coaxial with the neck and the said ring support is fixed to the said coaxial bore, the thickness of the said transition area facing the said bore being equal to or greater than the average thickness of the neck.

The valve comprises a ring support and a sealing element which is supported (either closing it or not) above an opening formed in the said ring support, which is fixed on the inner surface of the head or close to the bottom of the neck, in other words at the bottom of the duct formed by the neck or near the neck, on the inner surface of the shoulder. The sealing element comprises a sealing means that forms an obstacle to product flow through the opening or hole formed in the ring support. There is no need to choose a sealing means shape such that it can be inserted in the hole (for example a conical insertion), since the displacement imposed on the sealing means when the user presses on the skirt is such that the skirt cannot easily return to exactly the same position. It is better to have a disk with a diameter significantly larger than the diameter of the hole. The hole diameter should preferably be approximately equal to or larger than the diameter of the port. A sealing means of this type can control the required distribution flow with a limited displacement.

According to the invention, there is no reason why the sealing means, the opening, the ring support and the bore should have a symmetry of revolution, but since this is the case the most frequently encountered, we will discuss diameters as a means of defining dimensions in the remainder of the description.

The lower part of the neck is the transition area between the neck and the shoulder that extends on each side of the boundary between the basically cylindrical part of the neck and the basically conical part of the head over a distance typically equal to approximately one and a half to two times the largest of the average thicknesses of each of these parts. It comprises a bore coaxial with the neck in which the ring valve support will be fitted, the said bore being designed to make it easy to keep the ring support firm in the said bore.

This firm support is achieved by providing the most rigid possible housing for the said ring support. This is why, according to the invention, the thickness of the said bottom part of the neck facing the said bore must be approximately equal to or greater than the average thickness of the neck, this neck thickness usually itself being greater than the average thickness of the shoulder. The stiffness of the bottom part of the neck is also due to the geometric effect at the intersection between a cylinder and a cone.

In general, an outer shoulder is formed at the lower part of the neck (transition zone that is also called the "neck bottom"), to form a transition without any unaesthetic hollow between the outer surface of the outer skirt of the capsule and the outer surface of the tube wall. This shoulder, that we will call the "neck bottom" in the remainder of this description, participates in the increase in thickness and therefore the increase in stiffness of this area.

Finally, this area is small, particularly in height. It thus provides a rigid and stable housing for the ring support of the valve. The result is not only good mechanical strength of the head fitted with its valve but also good leak tightness, both for the product (which must only pass through the valve) and for air, which must not pass between the ring support of the valve and this bore, otherwise the product could be polluted. Therefore, it is not recommended that the bore and the ring support of the valve should be attempted to be held firmly in contact except in the said lower part of the neck since the contact is not stable because the parts outside this area (particularly the neck) are too easily deformable, causing a risk of loss of leak tightness.

Firm support of the valve in the head may be complemented by various means at the contact between the outer surface of the ring support of the valve and the surface of the bore. Thus, the valve could be fixed by simple force fitting of the ring support in the bore, for example by defining the outside diameter of the ring support as being larger by 1 to 5% than the bore diameter, when these values are unconstrained. But the ring support can also be kept firmly closed in the said bore by gluing the surfaces that will be brought into contact with each other, or by welding them. The attachment may also be made by a combination of clamping and thermal input, by differential heat shrinkage; under the effect of heat, the plastic material of the head (close to the bottom of the neck) shrinks more than the plastic material in the ring support, such that even if there is no intimate weld between the two plastic materials, a mechanical clamping action is set up between the two parts.

Regardless of whether solidarisation is done simply by clamping or by gluing or by the addition of heat, the valve has a part that is introduced into the neck first and is smaller than the said bore, and another part comprising the ring support for which the shape and dimensions are similar to the shape and dimensions of the bore, keeping the valve fixed to the neck. The result is that the part of the valve that is inserted into the neck first is not damaged, because clamping and/or gluing only take place at the end of penetration of the valve into the neck.

According to one particular embodiment of the invention, the said ring support is attached to the said bore by force fitting and the outer surface of the said ring support and the bore surface are provided with complementary solidarisation means. These means compensate for the fact that the clamping reduces with time due to stress relaxation. These complementary solidarisation means consist of at least axial immobilisation means; for example a groove and a bead or two circumferential beads, that may or may not be continuous. These beads are additional means and the dimensions of the relief are not necessarily large; a discontinuous bead with a small radial upstand (typically 0.1 mm) is sufficient. Thus, force fitting is only slightly slowed, and the relief is not destroyed. Furthermore, this type of relief has small amplitude upstands that are easy to remove from the mould, which is particularly advantageous when the head is moulded directly onto the skirt under high-speed industrial conditions, the plastic material of the head being welded to the plastic material of the skirt without any material or heat being added except during moulding. Thus, an annular groove formed on the surface of the hollow body and rice grains uniformly distributed in the said bore are perfect to complement retaining the said ring support firmly in place in the said bore.

According to a first embodiment, a transverse top wall is placed above the said neck surrounding the port, and the sealing means is connected to the said transverse top wall through support elements that can be elastically deformed. The valve is then composed of two separate elements: a sealing means element fixed on (or moulded in a single piece with) the top wall of the head and a ring support in which an opening is formed that will be closed off by the said sealing means and placed by penetration into a bore formed close to the bottom of the neck. This embodiment is described in detail in the first example.

According to a second embodiment, the valve is a deformable element comprising a disk and a valve seating moulded in a single part, corresponding to the top part of the deformable element that will be used to pump pasty products described by the Applicant in EP 0 309 367. This element comprises two adjacent but spatially and functionally separate parts; in the lower part, a deformable film in the form of a thinned dome (through which the pasty product is sucked in) and in the upper part, a valve through which the pasty product is expelled. The Applicant was surprised to observe that this expulsion valve also provides perfect leak tightness for air. This embodiment is described in detail in the second example.

According to a third exemplary embodiment, the said sealing means is kept forced in position on the said ring support due to only the negative pressure inside the tube. This embodiment is described in detail in the third example.

According to a fourth embodiment, the valve comprises a sealing element consisting essentially of a sealing means connected to a ring through elastically deformable support elements, the bore in the ring providing a passage for the product to be distributed, the said ring and the said deformable support elements being designed to keep the sealing means in the closed position when the tube is not compressed and to enable it to be in the open position when the tube is compressed, the said sealing means element being inserted at least partially in a hollow body that is itself force fitted into a bore formed in the lower part of the neck. The said hollow body comprises a first open end oriented towards the port, and a second end oriented towards the inside of the shoulder (in other words towards the inside of the tube when the head is fixed on the tube skirt) and has a transverse wall through which there is a hole, the said sealing means being placed facing the said hole in the transverse wall in order to close it when the tube is under unstressed conditions, and the said ring being located near the open end of the said hollow body.

In this fourth embodiment, there is no need for the ring to be fully inserted in the bore of the hollow body, but it must be at least partially inserted in it, particularly the part containing the fasteners of the elastic support elements of the sealing means, such that the said elastic support elements can move and be deformed without encountering any obstacle other than the fluid product contained in the tube and can thus operate correctly. For example, the neck can have a transverse top wall that surrounds the port and acts as a stop trapping the ring between itself and the open end of the hollow body. In this case, one part of the ring is fitted with fasteners of collapsible support elements of the sealing means and is inserted in the hollow body, and the outer contour of another part approximately matches the contour of the bore of the neck and must be inserted in the bore of the neck before the hollow body.

The ring can also be fully inserted in the bore of the hollow body and can be fixed close to the open end of the hollow body by means of complementary fixing means, typically a groove and one or even two click fit beads located respectively on the outer surface of the ring and on the inner surface of the hollow body. Another advantage of this solution is that it solidarises the hollow body and the sealing means element before they are inserted into the tube head. The result is a standalone valve in which the hollow body houses the sealing element held compressed between the ring fixed to the inside of the first cylindrical wall close to its opening and the transverse wall of its second end. In this way, a single part can be inserted through the bottom of the neck, which facilitates high speed manufacturing conditions.

The two possible configurations for this valve can also be combined. The ring has two parts: one that is inserted in the hollow body and remains fixed in it due to complementary solidarisation means (typically click fitting) and another part, the outer contour of which is approximately the same as the contour of the hollow body, inserted into the bore of the neck first.

The sealing element is composed of a sealing means, a ring and elastically deformable support elements. These support elements are advantageously in the form of thin helical arms. It is composed of a plastic material chosen as a function of the required stiffness for these elastic support elements, typically a polyolefin or a polyester. Preferably, the sealing means element is equipped with at least two arms of this type, uniformly distributed. If complex shapes of moulds have to be made, there is no major difficulty in moulding the sealing element, due to the uniformity of the thickness and the symmetrical distribution (axisymmetry) of the elements provided to obtain parts that are only slightly deformed at the end of cooling. The sealing element is then inserted in the hollow body and then inserted with the said hollow body (fixed to it on not) inside the neck.

The hollow body is force fitted into the bore of the neck such that the valve remains fixed inside the neck throughout the usage period of the collapsible distribution tube. It must resist the negative pressure that is developed inside the tube and increases as the product contained in the tube is consumed. Insertion by force is similar to clamping, in other words the bore diameter under unstressed conditions is less than the diameter of the hollow body, over at least part of the contact surface. Typically, with geometries and plastic materials usually used in collapsible tubes (contents about a hundred millilitres, low density polyethylene head, high density polyethylene valve), the forces to be resisted by clamping are of the order of 20 N, corresponding to a difference in diameter between 0.08 and 0.40 mm for an 8 mm diameter, which is equivalent to typical clamping of between 1 and 5%.

Preferably, the outer wall of the hollow body is essentially an axisymmetric wall composed of two cylindrical walls connected to each other by a shoulder. The first end is located on the first cylindrical wall. The second cylindrical wall has a larger diameter and the second end is on this wall. The geometry of the bore in the neck is identical: two cylindrical walls connected to each other by a shoulder, a cylindrical wall at the bottom of the neck with a diameter larger than the diameter of the cylindrical part close to the port.

The diameter of the first cylindrical wall of the hollow body is slightly less than the inside diameter of the neck in the corresponding part; there is no force necessary initially when the valve is inserted inside the neck. The first objective is to bring the centre line of the valve into line with the centre line of the bore, and to align them without applying any force. The diameter of the second cylindrical wall is slightly larger than the diameter of the corresponding bore at the bottom of the neck, such that at the end of penetration, when the second cylindrical wall of the hollow body comes into contact with this bore, a significant force has to be applied to overcome the clamping force and to force the valve to penetrate until the shoulder of the hollow body stops in contact with the shoulder of the bore.

In addition to clamping, axial immobilisation means are formed on the surface of the second cylindrical part of the hollow body and on the bore at the bottom of the neck. Since the shoulders already act as a stop preventing movement towards the opening, all that is necessary is to create a small amplitude bead on the bore of the bottom of the neck that prevents the valve from escaping, the valve itself being provided with a small bead on its second cylindrical wall. The bead formed on the bore at the bottom of the neck may be discontinuous and advantageously be in the form of uniformly distributed rice grains.

Despite their small size, the particular geometry of rice grains is sufficient to keep the valve firmly fixed in the bore of the neck, resistant to a force of 20 N.

The Applicant has observed that this type of valve, which is less complicated and less expensive than valves used in pumps of the type described in FR 2 732 315, are sufficient to keep the inside of the tube at a negative pressure protected from air for several months, provided that the opening is closed carefully after each use using a conventional closing cap. This valve, that was initially designed to prevent the flow of very liquid products, works surprisingly well even if the elastically deformable support elements are immersed in the product to be distributed, provided that the viscosity of the product does not exceed 7000 centipoises. If the viscosity is higher, the plastic material used to make the sealing means element may be chosen from among stiffer plastic materials, and particularly polypropylenes.

Regardless of which embodiments are chosen, the elements of the valve (elastic support and rigid sealing means for the first and fourth embodiments, annular flange and collapsible sealing means for the second embodiment, sealing means for the third embodiment) work with the inner wall of the ring support in continuous contact with the product to be distributed just before it comes out of the port. This fact can be beneficial if bactericide molecules are grafted on the surface using a process such as that described in PCT/FR97/01403. In particular, the prophylactic protection of the product contained in the tube can be considerably improved.

Leak tightness is better maintained over the long term if the tube skirt and the shoulder comprise at least one layer made of a plastic material with a good gas diffusion barrier property, such as (ethylene-vinyl alcohol) copolymer (EVOH).

PARTICULAR EMBODIMENTS OF THE INVENTION

FIG. 1 illustrates a partial half-section along a diameter of a particular tube head according to the invention corresponding to the first embodiment. The sealing means and its elastic support element are not shown in section.

FIG. 2*a* illustrates a half-section along a diameter of a particular tube head according to the invention corresponding to the second embodiment. FIG. 2*b* shows the single piece valve after moulding and before being inserted in the neck.

EXAMPLE 1 (FIG. 1)

Figure 1:
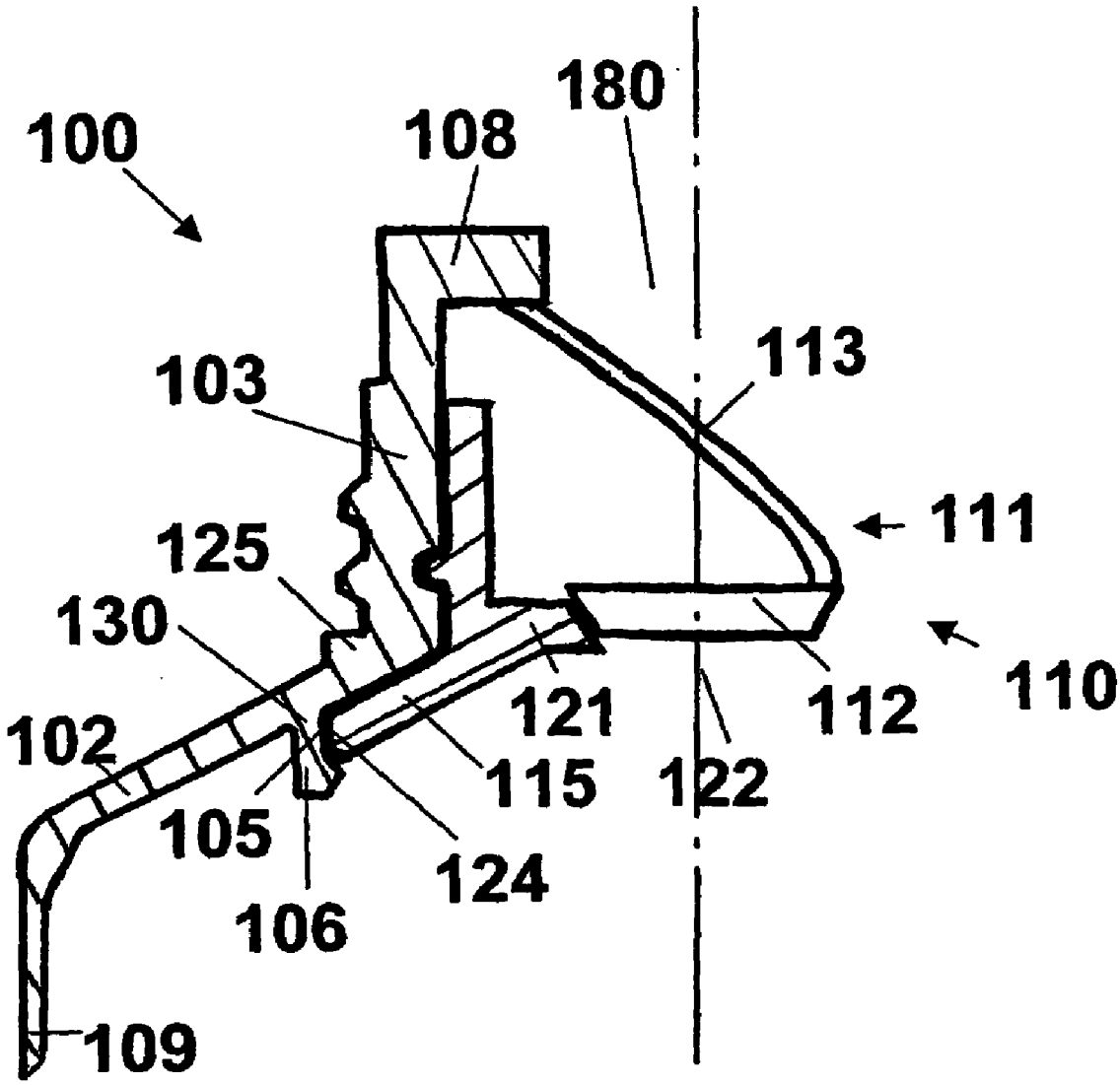

This example illustrates the first embodiment.

A transverse top wall 108 is placed on top of the neck 103 surrounding the port 180 and the sealing means 112 is connected to the said top transverse wall 108 by elastically deformable support elements 113. The valve is thus composed of two separate elements; a sealing means element 111 fixed on the top wall 108 of the head (or moulded with it in a single piece) and a ring support 115 in which an opening 122 is formed that will be closed by the said sealing means 112. The bottom of the neck is the transition area between the neck 103 and the shoulder 102. It comprises an attachment skirt 130 provided with a click fit bead 106 and a base 125 that is an outer shoulder designed to make a "hole"-free transition between the outer surface of the outer skirt of the cap (not shown) and the outer surface of the head of the tube 100.

The ring support 115 is put into place by penetration into the neck, its bottom part being blocked in contact with the inner wall of the attachment skirt 130 formed at the bottom of the neck. This inner wall forms a bore 105 formed close to the bottom of the neck 103. The attachment skirt 130 is provided with a click fit bead 106 near its end that traps the end of the ring support 115.

Figure 2A:
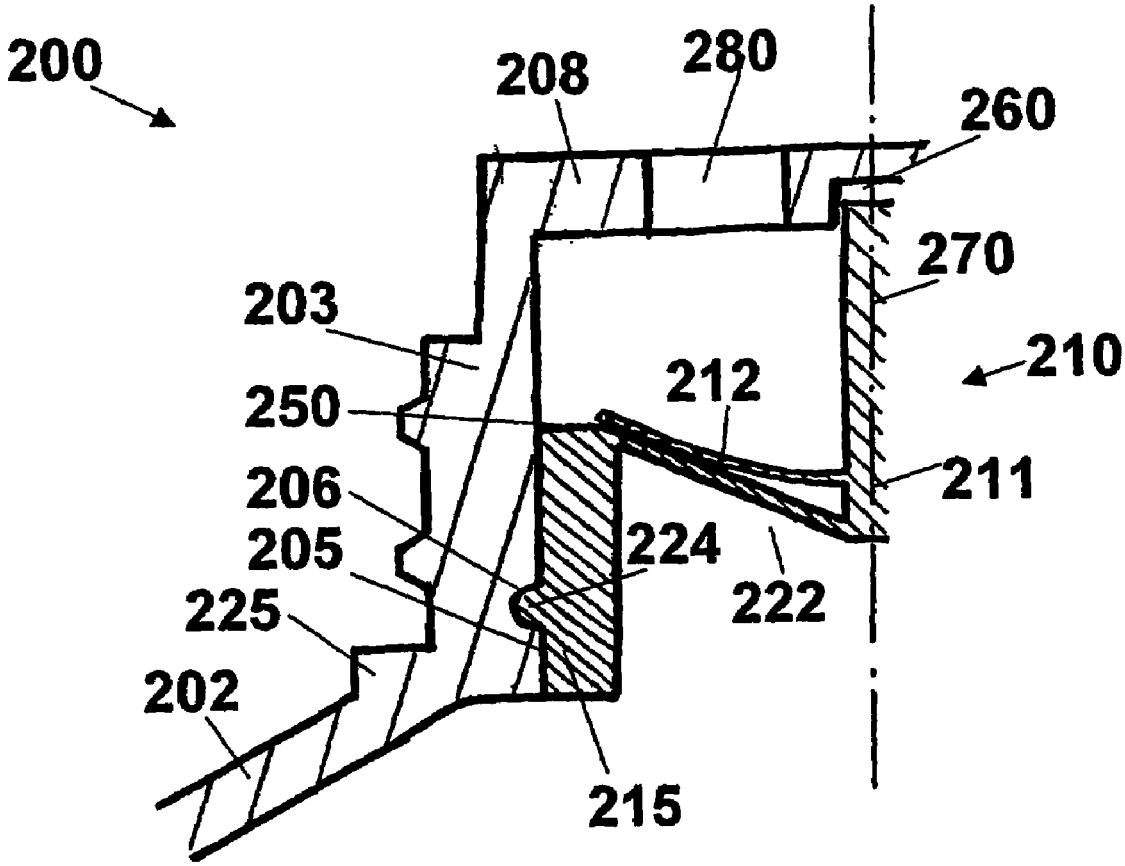
Figure 2B:
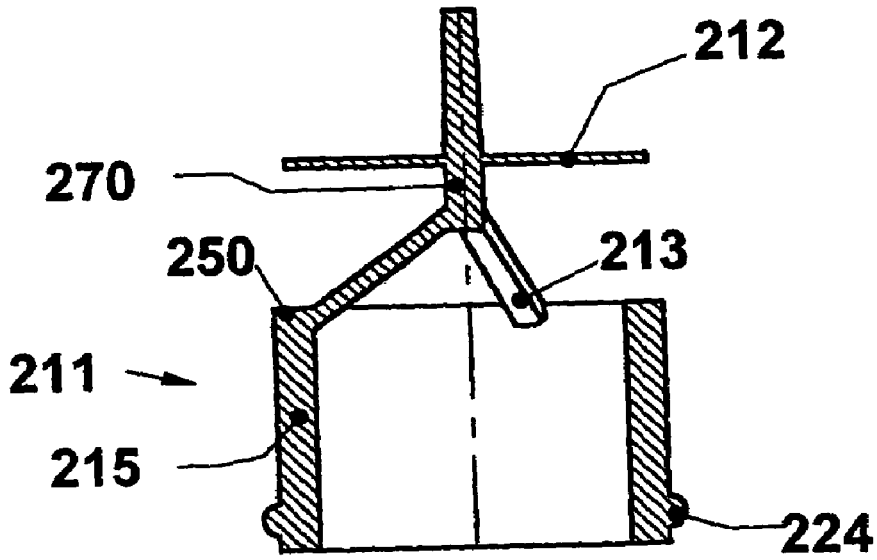

EXAMPLE 2 (FIGS. 2*a* and 2*b*)

This example illustrates the second embodiment.

The valve is a deformable element comprising a collapsible sealing means 212 and a ring support 215, of which one end 250 acts as a valve seating. The assembly is cast in a single part. It corresponds to the top part of the deformable element that will be used to pump pasty products described by the Applicant in EP 0 309 367 and comprising a deformable film near the bottom in the form of a thinned dome (through which the pasty product will be sucked in) and near the top, a valve through which the pasty product is expelled. FIG. 2*b* shows this expulsion valve that is used within the context of this invention as a non-return valve. It is illustrated in the geometric configuration in its state just after moulding and before it is inserted inside the neck. It has two stable equilibrium positions; the first, obtained after moulding, is shown in FIG. 2*b* and the second is reached after penetration into the neck; the support elements of the sealing means 213 are placed in a configuration symmetric with the original configuration (see FIG. 2*a*) with respect to the plane defined by their fasteners on the ring support 215, which entrains the collapsible sealing means 212, or at least its attachment onto the central rod 270, towards the inside of the tube.

The periphery of the collapsible sealing means 212 bears on the end of the ring support 215 that thus acts as a valve seating. Under the effect of pressure on the tube, the sealing means deforms slightly more and allows the product to pass through. As soon as pressure on the tube is removed, the end of the sealing means once again bears on the end of the ring support 215.

The sealing means and the support elements are connected to a central rod 270 that remains coaxial with the neck 203 as a result of a cavity 260 formed in the centre of the transverse top wall 208. In this embodiment, the end of the neck has several annular openings 280 instead of a central opening.

The bottom of the neck is the transition area between the neck 203 and the shoulder 202. It comprises a base 225 that is an outer shoulder that will make a "hole"-free transition between the outer surface of the outer skirt of the cap (not shown) and the outer surface of the head of the tube 200.

When the valve is inserted in the neck, the end of the rod 270 stops in contact with the cavity 260 and the valve moves into its second stable geometric configuration, the circumference of the collapsible sealing means bearing on the top end 250 of the ring support 215. The outer diameter of the ring support 215 is greater by 2% than the diameter of the lower part 205 of the bore of the neck 203. The ring support and the bore are provided with complementary click fit means 206 and 224.

EXAMPLE 3 (FIG. 3)

This example illustrates the third embodiment.

The bottom of the neck is the transition area between the neck 303 and the shoulder 302. It comprises a base 325 that is an outer shoulder that will provide a "hole"-free transition between the outer surface of the outer skirt of the cap (not shown) and the outer surface of the head of the tube 300.

Figure 3:
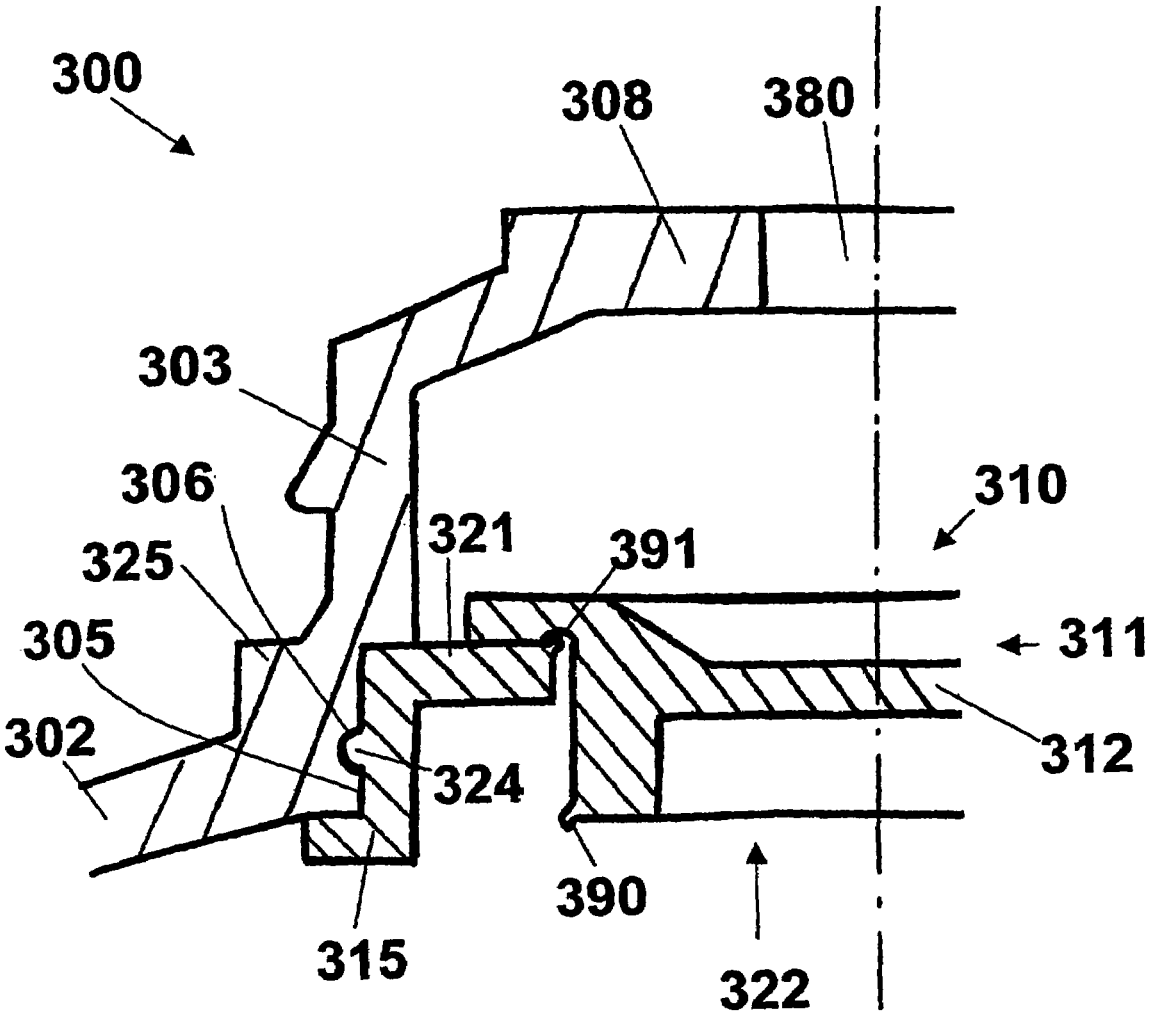
FIG. 3 illustrates a half-section along a diameter of a particular tube head according to the invention corresponding to the third embodiment.

The sealing means 312 and the ring support 315 are moulded in a single piece; they are kept together by easily breakable bridges. FIG. 3 shows portions 390 and 391 of one of these bridges after it has been broken. Breaking is achieved simply by pressing on the part corresponding to the sealing means towards the part corresponding to the ring support.

It is preferable if the bridges are broken by pushing them inwards immediately before the assembly of the two parts is inserted into the neck. In this way, the sealing means 312 is trapped between the ring support 315 force fitted or glued into the bore 305 at the bottom of the neck and the transverse top wall 308.

The only force keeping the sealing means 312 in contact on the ring support 315 is the negative pressure inside the tube.

When pressure is applied to the skirt of a tube, the product applies pressure on the sealing means and the sealing means is lifted. When the pressure is removed, the elastic return of the skirt causes a negative pressure that once again pushes the sealing means into contact with the transverse wall 321 of the ring support 315 surrounding the opening 322. In this case, since the elastic return of the skirt is a driving element, it will be chosen to be made from a rigid material or a set of rigid materials with dead fold property.

EXAMPLE 4 (FIG. 4)

The head of the tube 400 has a neck 403 with a port 408 and a substantially tapered shoulder 402 connecting the skirt 409 of the tube to the neck 403. A cylindrical housing or bore 405 with a diameter equal to approximately the diameter of the second cylindrical wall 417 of the hollow body 415 of the valve, is formed on the inner surface of the bottom of the neck.

The bottom of the neck is the transition area between the neck 403 and the shoulder 402. It comprises a base 425 that is an outer shoulder that enables a "hole"-free transition between the outer surface of the outer skirt of the cap (not shown) and the outer surface of the head of the tube 400.

A discontinuous bead is formed on the cylindrical housing 405 in the form of rice grains 406 that click fit into a circumferential groove 424 formed on the second cylindrical wall 417 of the valve 410. The depth of the cylindrical housing 405 is such that the shoulder 407 connecting it to the bore of the central part of the neck acts as a stop for the shoulder 418 connecting the first cylindrical wall 416 and the second cylindrical wall 417 of the valve 410, such that the valve is fixed in axial translation by clamping of the second cylindrical wall 417 in the housing 405, by the shoulder 407 and the rice grains 406 trapped in the circumferential groove 424.

The outer wall of the hollow body 415 is an axisymmetric wall composed of two cylindrical walls connected to each other by a shoulder. The first cylindrical wall 416 is provided with a first end 419 that is open and faces the port 480. The second cylindrical wall 417 has a larger diameter and is provided with a hole 422 at the second end at which there is the transverse wall 421. The geometry of the bore in the neck is exactly the same: two cylindrical walls connected to each other by a shoulder, a cylindrical wall 405 at the bottom of the neck with a diameter larger than the diameter of the cylindrical wall 404 located close to the port.

The diameter of the first cylindrical wall 416 of the hollow body 415 is smaller than the diameter of the bore 404 of the neck in the corresponding part; there is no force at first when the valve is inserted inside the neck. The first step is to align the centre line of the valve with the centre line of the bore without applying any force. The diameter of the second cylindrical wall 417 is equal to 8.2 mm, which is larger than the 7.9 mm diameter of the corresponding bore 405 in the bottom of the neck, such that at the end of force fitting, when the second cylindrical wall of the hollow body comes into contact with this bore, a significant force (of the order of 10 N) must be applied to overcome the clamping force and to make the valve penetrate until the shoulder 418 of the hollow body comes into contact with the shoulder 407 of the bore.

Six uniformly distributed rice grains 406 are created to prevent the valve from escaping, and to complement the clamping force applied over the height of the second cylindrical wall 417 (about 3.8 mm). These rice grains are trapped in a shallow (0.1 mm radial height) circumferential annular groove 424 formed on the second cylindrical wall 417 of the hollow body 415.

The valve thus fixed in the bore of the neck resists a pull out force of 20 N. The hollow body 415 with the second cylindrical wall 417 acts as the ring support claimed in this invention.

The sealing means element 411 is composed of a sealing means 412, a ring 414 and three elastically deformable support elements 413 in the form of thin single-turn helical arms. They are made of high-density polyethylene. They are 0.3 mm thick and 0.7 mm long. For creams for which the viscosity is more than 5000 centipoises, they need to be thickened to increase their elastic stiffness. As long as they are less than 0.5 mm thick and less than 1 mm wide, they do not occupy much space and they do not disturb the flow of the product.

Although this valve was initially designed to act as a valve for liquid products with low viscosity, it can also be used with fairly viscous creams (up to 7000 centipoises).

Figure 4:
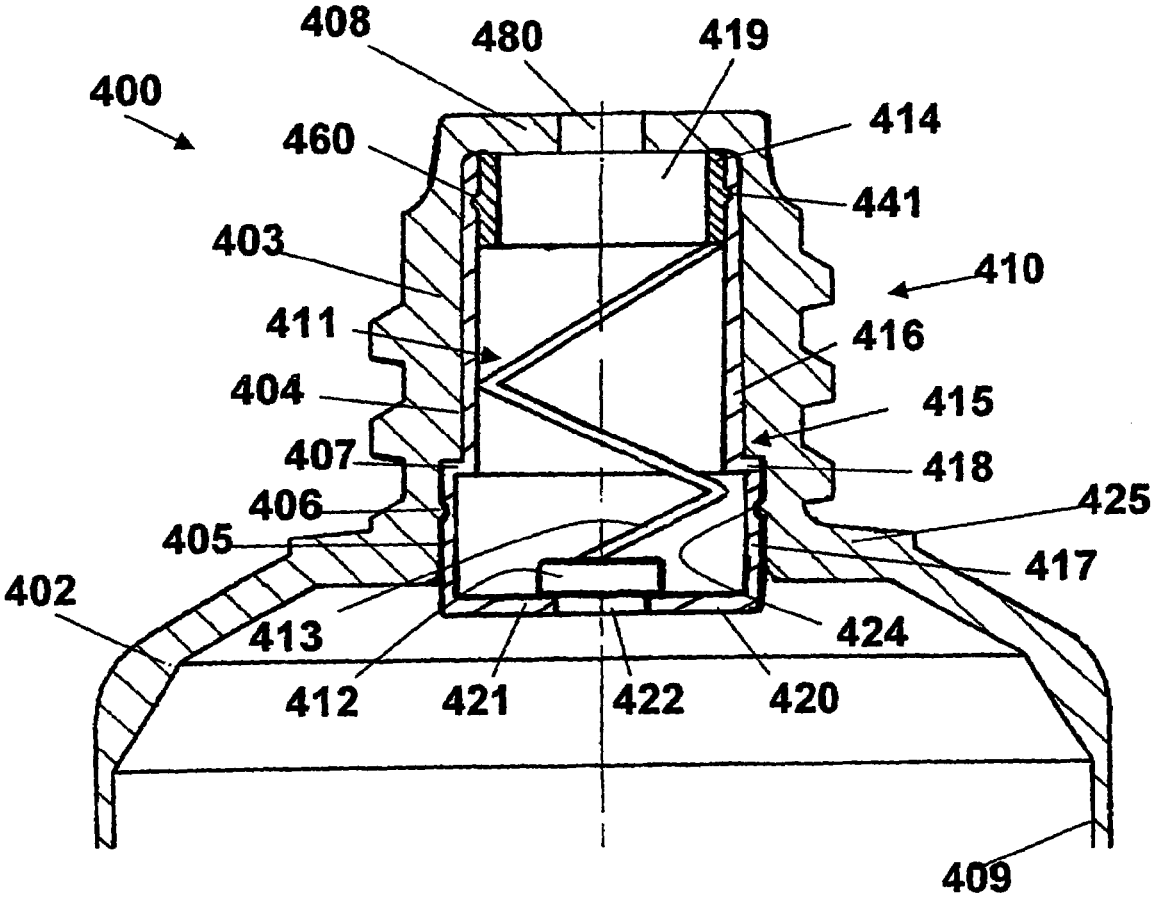
FIG. 4 illustrates a section along a diameter of a particular tube head according to the invention corresponding to the fourth embodiment.

In a preferred embodiment not shown in FIG. 4, the height of the second cylindrical wall 417 is reduced such that the transverse wall 421 is flush with the inner surface of the shoulder 402, thus improving the tube delivery ratio.

Advantages

- valves easier and therefore less expensive to make than airless pump valves under high speed industrial conditions, while satisfactorily performing their "non-return" function in most cases.
- the bore of the tube head and the valve are provided with compact mutual solidarisation means that are easy to remove from the mould, so that this type of tube head can be made economically at high speeds.

Parts list

| FIG. 1 | FIG. 2 | FIG. 3 | FIG. 4 | |
|---|---|---|---|---|
| 100 | 200 | 300 | 400 | tube head |
| 102 | 202 | 302 | 402 | shoulder |
| 103 | 203 | 303 | 403 | neck |
| | | | 404 | neck upper bore |
| 105 | 205 | 305 | 405 | housing, neck lower bore |
| 106 | 206 | 306 | 406 | fixing means, click fit means, rice grain |
| | | | 407 | shoulder in the neck bore |
| 108 | 208 | 308 | 408 | neck transverse top wall |
| 109 | | | 409 | skirt |
| 110 | 210 | 310 | 410 | valve |
| 111 | 211 | 311 | 411 | sealing element |
| 112 | 212 | 312 | 412 | sealing means |
| 113 | 213 | | 413 | support element 113, 413: elastically deformable 213: with two equilibrium positions |

-continued

Parts list

| FIG. 1 | FIG. 2 | FIG. 3 | FIG. 4 | |
|---|---|---|---|---|
| | | | 414 | ring |
| | | | 441 | annular click fit rim |
| 115 | 215 | 315 | 415 | ring support (415: hollow body) |
| | | | 416 | first cylindrical wall |
| | | | 460 | annular groove |
| | | | 417 | second cylindrical wall |
| | | | 418 | shoulder between the first cylindrical wall and the second cylindrical wall |
| | | | 419 | first end (open) |
| | | | 420 | second end |
| 121 | | 321 | 421 | transverse wall |
| 122 | 222 | 322 | 422 | orifice |
| 124 | 224 | 324 | 424 | complementary click fit means |
| 125 | 225 | 325 | 425 | bottom of the neck |
| 130 | | | | attachment skirt |
| | 250 | | | end of the ring support acting as the valve seating |
| | 260 | | | central cavity |
| | 270 | | | central rod |
| 180 | 280 | 380 | 480 | port |
| | | 390 and 391 | | portions of the break-off bridge after the bridge has broken |

The invention claimed is:

1. A collapsible tube head comprising a neck fitted with a port and a shoulder that will connect the neck to the tube, the head being fitted with a valve inserted in the neck of the collapsible tube, the valve comprising a sealing means associated with a ring support provided with an opening, the sealing means being held in a closed position of the opening when the tube is not compressed and in an open position when the tube is compressed, a lower part of the neck being provided on its inner surface with a bore coaxial with the neck on which the ring support is fixed, the thickness of the lower part of the neck facing the bore remaining approximately equal to or greater than the average thickness of the neck, wherein the ring support is a hollow body in which a sealing element is at least partially inserted, the sealing element consisting essentially of the sealing means connected to a ring through elastically deformable support elements, the ring having a bore providing a passage for the product to be distributed, the ring and the deformable support elements being constructed and arranged to keep the sealing means in the closed position when the tube is not compressed and to enable the sealing means to be in the open position when the tube is compressed, the ring being at least partially inserted in the bore of the hollow body and fixed to the bore of the hollow body by means of complementary fixing means located adjacent the open end of said hollow body.

2. The tube head according to claim 1 wherein the ring support is fixed to the bore by means of bonding, soldering or differential heat shrinkage.

3. The tube head according to claim 1 wherein the ring support is fixed to the bore by force fitting, the difference in diameter of the ring support and the bore under unstressed conditions being equivalent to clamping of between 1 and 5%.

4. The tube head according to claim 1, wherein the ring support and the bore are also fitted with complementary fixing means.

5. The tube head according to claim 4 wherein the complementary fixing means are click fit beads or grooves.

6. The tube head according to claim 5, wherein the complementary fixing means comprise an annular groove formed on the surface of the hollow body and rice grains uniformly distributed in the bore located adjacent the bottom of the neck.

7. The tube head according to claim 1 wherein the hollow body comprises a first open end oriented towards the port and a second end oriented towards the inside of the tube, and has a transverse wall through which there is the opening, the sealing means being placed facing the opening in order to close it when the tube is under unstressed conditions, and the ring being located near the open end of the hollow body.

8. The tube head according to claim 1 wherein the neck has a transverse top wall that surrounds the port and acts as a stop trapping the ring between the top wall and the open end of the hollow body.

9. The tube head according to claim 1, wherein the elastically deformable support elements are at least two helical arms made of polyolefin, with a thickness less than 0.5 mm and a width less than 1 mm.

10. The tube head according to claim 1, wherein the diameter of the opening of the ring support formed in the transverse wall of the hollow body is similar to or less than the diameter of the opening.

11. The tube head according to claim 1, wherein the outer wall of the hollow body is an axisymmetric wall composed of two cylindrical walls connected to each other by a shoulder, a first cylindrical wall being provided with the first end, a second cylindrical wall having a larger diameter and being provided with the second end and wherein the bore of the neck has a cylindrical wall at the bottom of the neck and a cylindrical wall located adjacent the port, with a diameter less than the diameter of the cylindrical wall located at the bottom of the neck, the first cylindrical wall in the hollow body having a diameter slightly less than the diameter of the cylindrical wall of the neck in the corresponding part, the second cylindrical wall having a diameter slightly larger than the diameter of the corresponding bore located at the bottom of the neck, such that the said clamping force is applied over the height of the cylindrical wall at the bottom of the neck.

12. The tube head according to claim 1, wherein the surface of the elements of the valve inserted in the neck is provided with bactericide molecules.

13. The tube head according to claim 1, wherein the lower part of the neck extends on each side of a boundary between a substantially cylindrical part of the neck and a substantially conical part of the shoulder over a distance equal to approximately two times the largest of the average thicknesses of the neck.

14. A collapsible tube head comprising a neck fitted with a port and a shoulder that will connect the neck to the tube, the head being fitted with a valve inserted in the neck of the collapsible tube, the valve comprising a sealing means associated with a ring support provided with an opening, the sealing means being held in a closed position of the opening when the tube is not compressed and in an open position when the tube is compressed, a lower part of the neck being provided on its inner surface with a bore coaxial with the neck on which the ring support is fixed, the thickness of the lower part of the neck facing the bore remaining approximately equal to or greater than the average thickness of the neck, wherein the ring support is a hollow body in which a sealing element is at least partially inserted, the sealing element consisting essentially of a sealing means connected to a ring through elastically deformable support elements, the ring having a bore providing a passage for the product to be distributed, the ring and the deformable support elements being constructed and arranged to keep the sealing means in the closed position when the tube is not compressed and to enable the sealing means to be in the open position when the tube is compressed, the neck having a transverse top wall that surrounds the port and acts as a stop trapping the ring between the top wall and the open end of the hollow body.

* * * * *